United States Patent [19]

Caputo

[11] Patent Number: 4,776,434

[45] Date of Patent: Oct. 11, 1988

[54] METHOD AND APPARATUS FOR SMOOTHLY STOPPING AN ELEVATOR CAR AT A TARGET FLOOR

[75] Inventor: William R. Caputo, Wyckoff, N.J.

[73] Assignee: Westinghouse Electric Corp., Pittsburgh, Pa.

[21] Appl. No.: 150,331

[22] Filed: Jul. 29, 1987

[51] Int. Cl.[4] ..... B66B 1/30

[52] U.S. Cl. ..... 187/118

[58] Field of Search ..... 187/116, 118

[56] References Cited

U.S. PATENT DOCUMENTS 4,354,577 10/1982 Yonemoto ..... 187/118

4,501,344 2/1985 Uherek et al. ..... 187/118

*Primary Examiner*—William M. Shoop, Jr.

*Assistant Examiner*—W. E. Duncanson, Jr.

*Attorney, Agent, or Firm*—D. R. Lackey

[57] ABSTRACT

A method and apparatus for smoothly stopping an elevator car at a target floor in an elevator system which utilizes a speed pattern to control car speed via a speed feedback control loop. When the elevator car reaches a predetermined slowdown point relative to a target floor, the speed pattern is changed towards a predetermined minimum non-zero value, with the non-zero value being selected to insure that the car will reach the floor in the event of error in the arrangement used to change the value of the speed pattern. The speed pattern value is then independently forced to a value indicative of zero car speed in response to a detector which detects the actual presence of the elevator car as it reaches a predetermined small dimension from the target floor, to stop the car at floor level, before a holding brake is applied.

4 Claims, 4 Drawing Sheets

ACTUAL CAR POSITION DETECTOR
208
10
202
38
42
40
48
FIRING PULSES
200
44
46
56
MOTOR CONTROLLER
14
TIMING
12
36
CONTROLLABLE IMPEDENCE
66
16
T1
34
52
VT1
76
77
68
LU, LD
32
51
62
+15V
64
VT1
LIMITING CONTROL
SMOOTH STOP CONTROL
74
60
VSP'
72
NL16
206
CONTROLLED VOLTAGE SOURCE
30
18
SLOPE LIMITER
58
VSP
SPEED PATTERN GENERATOR
50
SUPERVISORY CONTROL
129
DISTANCE PULSES

METHOD AND APPARATUS FOR SMOOTHLY STOPPING AN ELEVATOR CAR AT A TARGET FLOOR

TECHNICAL FIELD

The invention relates in general to elevator systems which utilize a speed pattern in a speed feedback control loop for controlling the speed of an elevator car, and more specifically to methods and apparatus for smoothly stopping such an elevator car at a target floor.

BACKGROUND ART

It is common to control the speed of an elevator car by generating a speed pattern signal having a magnitude responsive to desired car speed. The magnitude of the speed pattern signal may be time dependent, car position dependent, or a combination of both. For example, the speed pattern magnitude may build up to a predetermined value in an incremental counter, via "distance pulses" which are generated in response to predetermined increments of car movement, and when the car reaches a predetermined distance from a target floor, the distance pulses would then start to decrement te counter. Alternatively, pattern values may be stored in a read-only memory (ROM) with the distance pulses being used to clock out the values of the pattern.

If everythin is properly adjusted, and there is no electrical noise in the system which falsely changes the value of the speed pattern during landing, or blocks a required change, the elevator car will always make a smooth landing. Unfortunately, misadjustments and electrical noise do occur, causing overshooting, undershooting, application of the holding brake while the car is still moving, and the like, which degrades the quality of the landing. Also, errors occur due to building settling, i.e., a change in the actual distance between one point to another. Thus, it would be desirable and is the object of the invention to provide new and improved methods and apparatus which will overcome misadjustments and improper pattern levels to always bring the car to the target floor with a smooth, high quality landing.

DISCLOSURE OF THE INVENTION

Briefly, the present invention is a method, and apparatus for performing the method, of smoothly stopping an elevator car at a target floor, in an elevator system which controls car speed by comparing a speed pattern with actual car speed. When the elevator car approaches a target floor, the speed pattern is changed towards zero, but the means for changing the speed pattern cannot actually reduce the speed pattern to zero. For example, if the speed pattern is stored in an incremental counter which is decremented by distance pulses, the distance pulses cannot zero the counter. If the pattern is stored in ROM, the last value output by the ROM is a predetermined non-zero value, and the output of the ROM cannot be changed to zero regardless of how many distance pulses are used to address the ROM.

Actual presence of the elevator car at a predetermined dimension from the level of the target floor is detected, and this detection of the car is used to change the speed pattern signal to zero at the point where the speed pattern signal is applied to the motor control circuitry. Thus, the speed pattern signal being generated will still be the predetermined non-zero value, but the signal is shorted to ground at the point it is applied to the motor control when the elevator car actually arrives at the predetermined small dimension from the target floor. The speed pattern cannot be zeroed before the car reaches a point where a zero pattern is necessary to effect a smooth stop. This insures that the car will always reach the target floor. On the other hand, the car cannot reach the level of the target floor with the non-zero speed pattern signal still being applied to the motor control, because when the car reaches the predetermined small dimension from the target floor, the speed pattern is shorted, forcing the speed pattern signal which is applied to the motor control to a zero value. When the pattern applied to the motor control is forced to zero before the car reaches the level of the target floor, the motor control responds by stopping the car smoothly at floor level, before the holding brake is applied. Thus, smooth landings are assured every time, notwithstanding slight misadjustments which may creep into the control over time, and notwithstanding missed counts, or additional counts due to electrical noise, which may prevent the speed pattern from being at the desired value at each incremental position of the elevator car as it approaches a target floor.

BRIEF DESCRIPTION OF THE DRAWINGS

The invention may be better understood and further advantages and uses of thereof more readily apparent when considered in view of the following detailed description of exemplary embodiments, taken with the accompanying drawings, in which.

DESCRIPTION OF PREFERRED EMBODIMENTS

Figure 1:
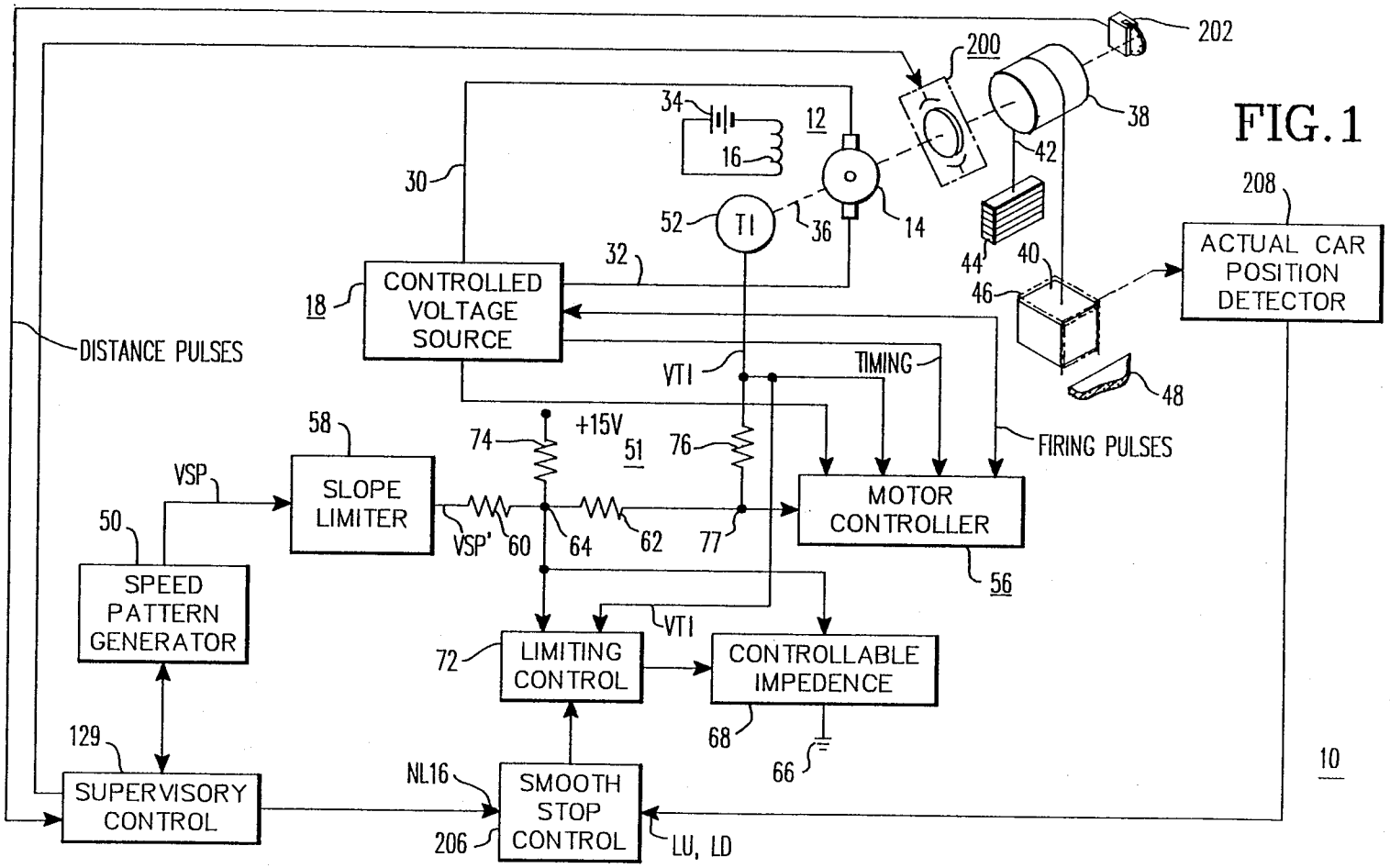
FIG. 1 is a schematic diagram of a feedback controlled elevator system which may utilize the teachings of the invention.

Referring now to the drawings, and to FIG. 1 in particular, there is shown an elevator system 10 which may utilize the teachings of the invention. FIG. 1 is similar to FIG. 1 of U.S. Pat. No. 4,161,235, which is assigned to the same assignee as the present application, and said patent is hereby incorporated into the specification of the present application by reference. Like reference numerals in the present application and in the incorporated patent refer to like functions and components, for ease in referring to the incorporated patent for additional information, if required.

Elevator system 10 includes a drive motor 12, with a DC motor being illustrated for purposes of example. Drive motor 12 may alternatively be an AC motor, as desired. DC motor 12 includes an armature 14 and a field winding 16. Armature 14 is electrically connected to an adjustable source 18 of direct current potential, such as an MG set or a static source, as desired. A motor controller 56 provides signals for controlling voltage source 18. Field winding 16 is connected to a source 34 of DC voltage, represented functionally by a battery.

Drive motor 12 includes a drive shaft, indicated generally by broken line 36, to which a traction sheave 38 is secured. An elevator car 40 is supported by wire ropes 42 which are reeved over traction sheave 38, with the other ends of ropes 42 being connected to a counterweight 44. Elevator car 40 is disposed in a hatch 46 of a structure having a plurality of floors, such as floor 48, which are served by elevator car 40. A tachometer 52 provides a signal VT1 responsive to the actual speed of elevator car 40. A holding brake 200 holds car 40 at floor level, when car 40 is stopped at a floor. Information relative to movement of car 40 may be provided by a pulse wheel system 202, which generates a distance or travel pulse in response to each predetermined increment of car movement, such as a pulse for each 0.25 inch of car movement.

The movement mode of car 40, and its position in hatch 46, are controlled by the voltage magnitude applied to armature 14. The magnitude of the voltage applied to armature 14 is responsive to a speed pattern signal VSP provided by a speed pattern generator 50, such as the speed pattern generator disclosed in U.S. Pat. No. 3,774,729, which is assigned to the same assignee as the present application. A servo control loop 51 controls the speed of the drive motor 12, and thus the position of car 40, in response to the velocity command or speed pattern signal VSP. Any servo control loop, which includes motor controller 56, may be used, such as disclosed in U.S. Pat. No. 4,030,570, which is assigned to the same assignee as the present application.

Control loop 51 is responsive to supervisory control 129 which receives calls for elevator service, car position or releveling signals LU and LD, and the distance pulses from pulse wheel 202. In response to these calls and signals, supervisory control 129 provides signal A for controlling brake 200, and signals for the speed pattern generator 50, such as signals which control the start of the speed pattern VSP, and the start of the deceleration or landing portion of the speed pattern. Suitable supervisory control is disclosed in the hereinbefore mentioned U.S. Pat. No. 3,774,729.

Signal VSP of the speed pattern generator 50, representing the desired car speed, and the velocity feedback signal VT1, representing the actual car speed, are applied to a summing point via summing resistors, and the output of the summing point is applied to motor controller 56. For example, speed pattern signal may be slope limited in function 58, and the slope limited speed pattern signal VSP' may be applied to a summing junction 77 via two serially connected resistors 60 and 62. The velocity signal VT1 is applied to junction 77 via a resistor 76.

Junction 64 between resistors 60 and 62 is connected to ground 66 via a controllable impedance device 68, such as a field effect transistor. Controllable impedance device 68 is controlled by a monitoring and limiting function 72, which monitors the speed pattern signal VSP' at junction 64. Junction 64 is also connected to a positive source of DC potential, such as +15 volts, via a resistor 74. The monitoring and limiting function 72 modifies the affect of the speed pattern signal on the motor controller 56 by reducing the impedance of the controllable impedance device by a controlled magnitude, which results in pulling the speed pattern signal VSP' closer to ground, or zero, regardless of the polarity of the speed pattern signal.

For purposes of example, the present invention, shown generally in FIG. 1 as function block 206 and labelled "smooth stop control", is introduced to the motor controller 56 via the limiting control 72. Smooth stop control 206 requires a signal from the supervisory control 129 when the elevator car 40 is approaching a target floor, such as a signal NL16 which goes true (logic one) when car 40 is sixteen inches from a floor at which it is going to stop, and signals from an actual car detector function 208. Elevator systems conventionally develop actual car position signals for releveling purposes, to indicate when releveling is necessary, and the direction of the releveling, such as the hereinbefore mentioned leveling signals LU and LD.

Figure 2:
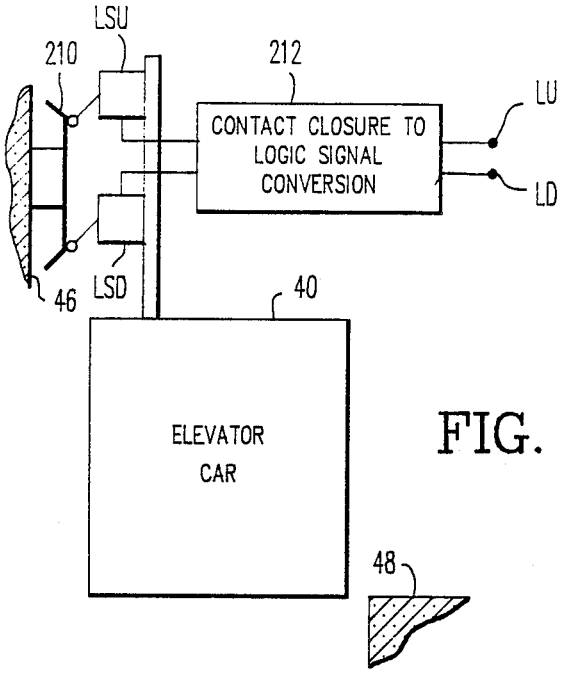
FIG. 2 is a schematic diagram of an arrangement which may be used to detect actual car position when the car reaches a predetermined small dimension from a target floor.

FIG. 2 illustrates how signals LU and LD may be developed from landing switches LSU and LSD, respectively, which are mounted on elevator car 40 and actuated by a cam 210 disposed in hatch 46 for each of the floors, such as floor 48. Function 212 converts contact closures of landing switches LSU and LSD to logic level signals LU and LD, respectively.

Figure 3:
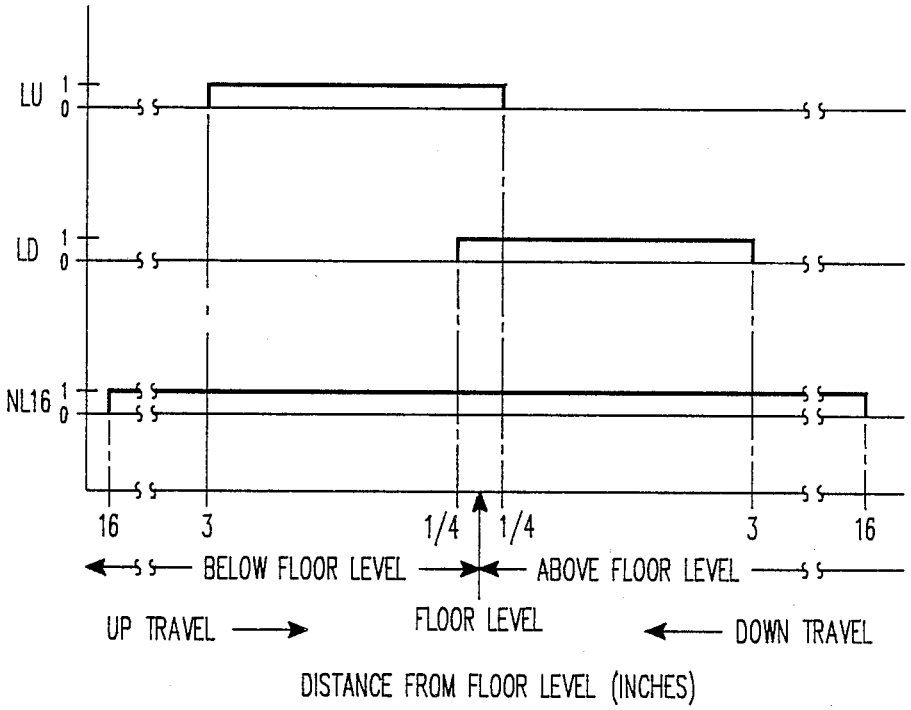
FIG. 3 is a graph which illustrates certain signals used by the invention, which signals are generated at predetermined dimensions from the level of a target floor, as the elevator car approaches a target floor.

FIG. 3 illustrates the logic levels of signals NL16, LU and LD as the elevator car 40 approaches a target floor from below and from above. For an up traveling car, signal NL16 goes true when car 40 is sixteen inches from a target floor. U.S. Pat. No. 3,774,749 illustrates the development of signal NL16 from distance pulses. Landing switch LSU is actuated by cam 210 when the elevator car is three inches from the target floor, and signal LU goes true at this point. When the car is 0.25 inch from the target floor, landing switch LSD is actuated by cam 210, and signal LD goes true at this point. Thus, the instant all three signals NL16, LU and LD are true, the car is 0.25 inch from a target floor, i.e., from the floor where the supervisory control 129 wants the car to stop. For a down traveling car, signal NL16 goes true when car 40 is sixteen inches from a target floor, landing switch LSD is actuated when the car is three inches from the target floor, causing signal LD to go true, and landing switch LSU is actuated when the car is 0.25 inch from the target floor, causing signal LU to go true. Thus, again, the first instant when all three signals are true signifies that the car is 0.25 inch from a target floor.

Figure 4:
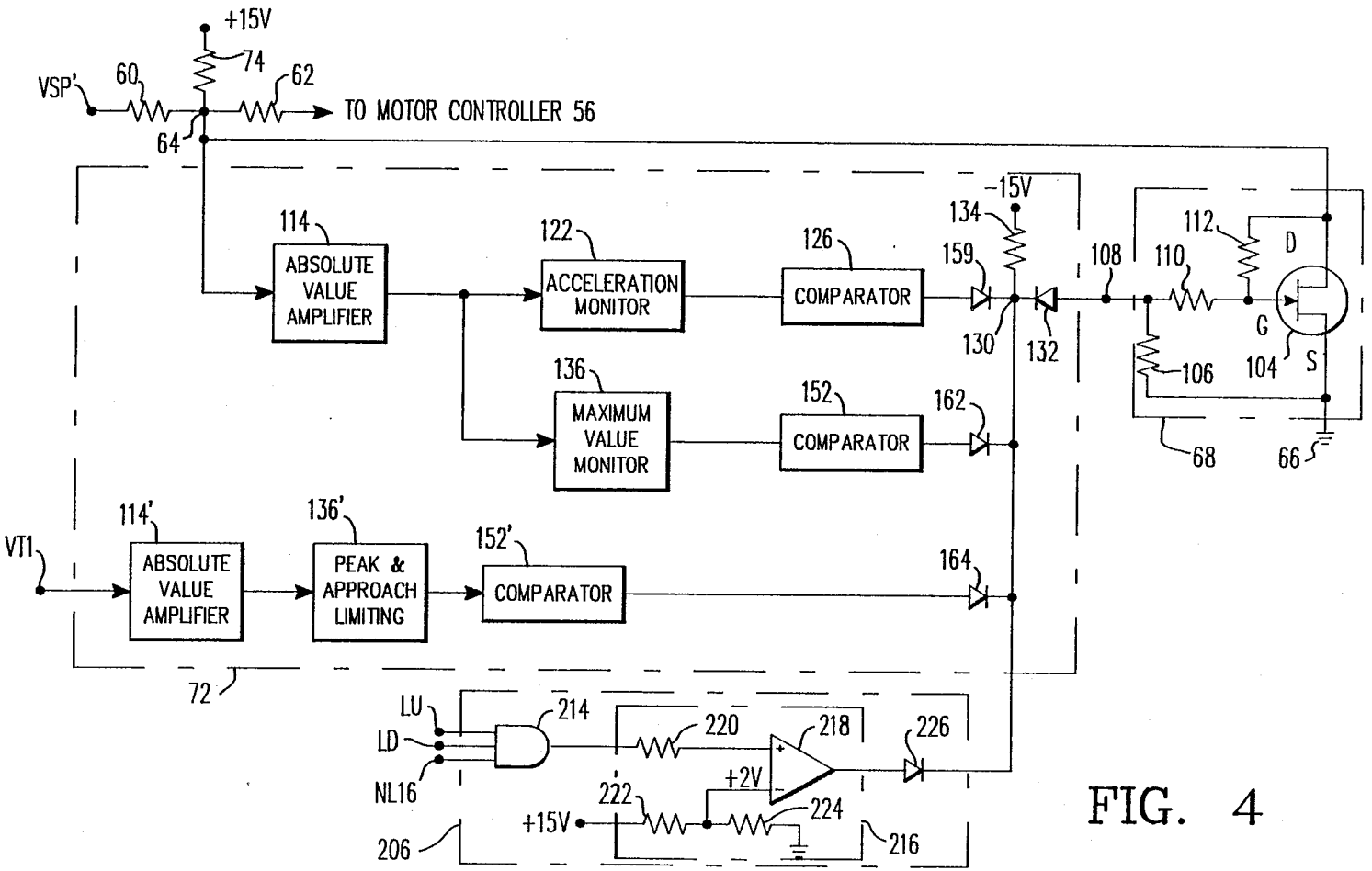
FIG. 4 is a detailed schematic diagram illustrating how the elevator system shown in FIG. 1 may be modified according to the teachings of the invention.

FIG. 4 is a schematic diagram of an exemplary embodiment of stop control 206, and how it may be connected to limiting control 72. FIG. 4 is similar to FIG. 2 of the incorporated patent, and thus the processing functions within the limiting control are shown in block form. Speed pattern signal VSP' is connected to the controllable impedance 68, such as to the drain D of junction field effect transistor 104, and it is also connected to limiting control 72, such as to an absolute value amplifier 114. An acceleration monitoring function 122 and comparator 126 process the output of amplifier 114 to monitor the rate of change of the speed pattern signal VSP', i.e., the requested acceleration, and comparator 126 provides a signal for a junction 130 via a diode 159. In like manner, another monitoring function 136 and comparator 152 process the output of amplifier 114 to monitor the maximum value of the speed pattern VSP', providing a signal for junction 130 via a diode 162. The actual car speed signal VT1 may also be monitored via an absolute value amplifier 114', a peak and approach limiting function 136', and a comparator 152', with comparator 152' providing a signal for junction 130 via a diode 164. As long as the outputs of comparators 126, 152 and 152' are negative, no limiting occurs, and the speed pattern VSP' is applied to motor controller 56 without modification. If the output of any comparator switches from negative to positive, junction 130 becomes less negative, reducing the drain to source resistance of JFET 104. If the speed pattern is positive, current flows away from junction 64, pulling the voltage at junction 64 towards ground. If the speed pattern is negative, current flows towards junction 64, also pulling junction 64 towards ground.

Smooth landing control 206 may include a three input AND gate 214 connected to receive signals NL16, LU and LD, with the output of AND gate 214 being connected to a comparator 216. Comparator 216 may include an operational amplifier (op amp) 218, for example, with AND gate 214 being connected to the non-inverting input of op amp 218 via a resistor 220. A reference voltage, such as +2 volts is applied to the inverting input of op amp 218, such as may be provided by a +15 volt DC source and a voltage divider constructed of resistors 222 and 224 connected serially from the DC source to ground. The output of op amp 218 is connected to junction 130 via a diode 226. When the output of AND gate 214 is low, the output of op amp 218 will be negative and the smooth stop control 206 will have no effect on junction 64. When the elevator car 40 reaches a point 0.25 inch from a target floor, the output of AND gate 214 will switch to a logic one, and the output of op amp 218 will switch to a sufficiently high positive value that junction 64 will be effectively tied to ground 66 via JFET 104. Thus, regardless of the value of the speed pattern signal VSP' applied to junction 64, the signal will be shorted to ground 66 and the value of the speed pattern signal which is input to junction 77 and the motor controller 56 will be zero or ground.

Figure 5:
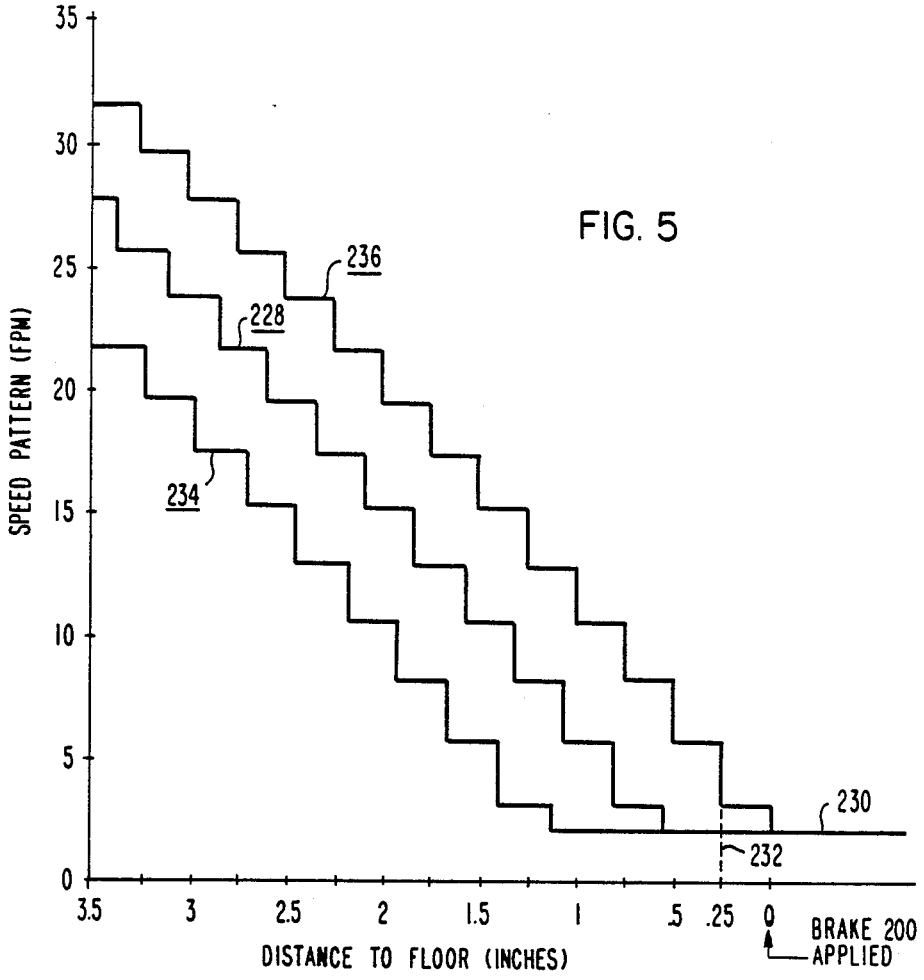
FIG. 5 is a graph illustrating both properly and improperly adjusted speed pattern landing signals, and how they are all effectively forced to zero at the input to the elevator motor control when the car reaches a predetermined dimension from floor level.

The speed pattern signal provided by speed pattern generator 50 is deliberately configured such that it approaches zero speed, but when it reaches some predetermined non-zero value close to zero car speed, such as about 2 feet per minute (FPM) the speed pattern ceases to change, remaining at this non-zero value. FIG. 5 is a graph which illustrates a landing speed pattern 228 being "stepped" by distance pulses towards zero speed as car 40 approaches a target floor. Speed pattern 228 does not step to zero but stops at 2 FPM, represented by pattern portion 230. However, even though the speed pattern VSP' applied to junction 64 never reaches zero a value indicative of zero car speed, junction 64 is forced to zero indicative of zero car speed, indicated by broken line 232, when the elevator car 40 is 0.25 inch from the floor level of the target floor. Speed pattern 228 illustrates speed pattern signal VSP' when it is in proper adjustment, as the minimum speed 230 is reached one distance pulse from the target floor.

Speed pattern signal 234 illustrates a speed pattern which reaches its minimum value 230 early. However, the pattern is not zeroed early by the forcing control, allowing the car to continue to travel to the 0.25 inch point, where the pattern is shorted to ground, applying a zero pattern to the motor controller 56.

Speed pattern signal 236 illustrates a speed pattern which does not reach its minimum value when it should. The invention shorts the speed pattern VSP' to ground at the 0.25 inch point, however, to smoothly stop the car at floor level, preventing an overshoot and/or brake application while the car 40 is still moving.

Figure 6:
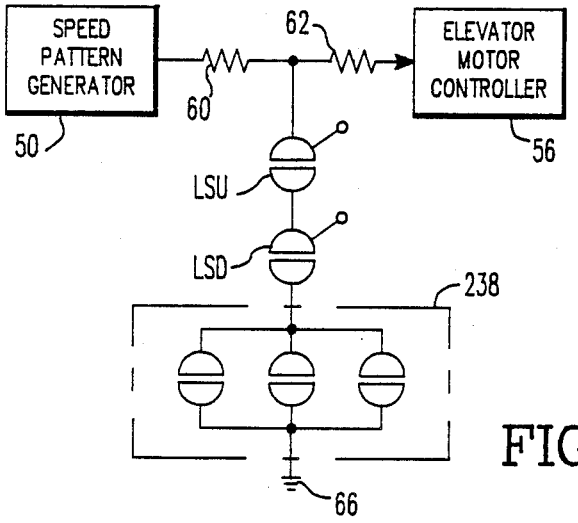
FIG. 6 is a schematic diagram illustrating how the invention may be applied to a relay controlled elevator system.

While the invention has been described using logic signals, it may be easily implemented in a relay based elevator system, as shown in FIG. 6. Parallel connected contacts 238 represent contacts of stopping relays, with the associated relays closing the contacts when the elevator car 40 is going to stop at the floor being approached. In other words, contacts 238 will all be open except when the car is in the process of landing at a target floor. Examples of stopping relays are the stopping relays which are energized for a car call, a hall call, for a terminal floor stop, and a parking floor stop, such as illustrated by relays T, S, TDC and P, respectively, in U.S. Pat. No. 3,584,707, which is assigned to the same assignee as the present application. Thus, when the elevator car is going to make a stop one of the contacts 238 of a stopping relay will close. When the car reaches a point three inches from the target floor, either landing switch LSU or LSD will close, depending upon car travel direction. When the car reaches the 0.25 inch point, the remaining landing switch will close, to complete a circuit which ground the pattern input to the motor controller 56.

What is claimed is:

1. A method for smoothly stopping an elevator car at a target floor, including a feedback control loop for an elevator drive motor which compares a speed pattern signal with a signal responsive to the actual speed of the elevator car, comprising the steps of:

changing the magnitude of the speed pattern signal towards a value indicative of zero car speed, as the elevator car approaches a target floor, with said changing step being incapable of changing the speed pattern signal to a value indicative of zero car speed, detecting the actual presence of the elevator car, when the elevator car is within a predetermined small dimension from the target floor, and forcing the speed pattern signal to a value indicative of zero car speed when said detecting step detects the actual presence of the elevator car at said predetermined small dimension.

2. The method of claim 1 wherein the step of changing the speed pattern signal includes the steps of generating pulses in response to predetermined increments of car travel, and stepping the speed pattern signal towards a predetermined minimum non-zero car speed value in response to said pulses.

3. The method of claim 1 wherein the step of changing the speed pattern signal changes the speed pattern signal in discrete steps, with the last step changing the speed pattern signal to a magnitude indicative of a car speed of about 2 FPM, and wherein the step of detecting the actual presence of the elevator car provides a signal which initiates the forcing step when the elevator car is about 0.25 inch from the target floor.

4. An elevator system, comprising:

an elevator car, motive means for said elevator car, speed pattern means for providing a speed pattern signal indicative of the desired speed of the elevator car, including a landing portion which has a predetermined minimum non-zero value, speed detector means providing a velocity signal responsive to the actual speed of the elevator car, control means controlling said motive means in responsive to the difference between said speed pattern signal and said velocity signal, stop means providing a signal when the elevator car is approaching a target floor, means responsive to said stop means for changing the speed pattern towards said predetermined minimum non-zero value as the elevator car approaches the target floor, means detecting the actual presence of the elevator car when the elevator car is a predetermined small dimension from the target floor, and means responsive to the detection of the elevator car for forcing the speed pattern signal to zero.

* * * * *